US011613412B2

(12) United States Patent
Grabarczyk et al.

(10) Patent No.: US 11,613,412 B2
(45) Date of Patent: Mar. 28, 2023

(54) TETHERED PLASTIC STOPPER

(71) Applicant: NOVEMBAL USA INC., Edison, NJ (US)

(72) Inventors: Henri Grabarczyk, Gleizé (FR); Stéphane Graux, Liergues (FR)

(73) Assignee: NOVEMBAL USA INC., Edison, NJ (US)

( * ) Notice: Subject to any disclaimer, the term of this patent is extended or adjusted under 35 U.S.C. 154(b) by 92 days.

(21) Appl. No.: 17/272,823

(22) PCT Filed: Sep. 9, 2019

(86) PCT No.: PCT/US2019/050261
§ 371 (c)(1),
(2) Date: Mar. 2, 2021

(87) PCT Pub. No.: WO2020/051597
PCT Pub. Date: Mar. 12, 2020

(65) Prior Publication Data

US 2021/0206536 A1 Jul. 8, 2021

Related U.S. Application Data

(60) Provisional application No. 62/728,849, filed on Sep. 9, 2018, provisional application No. 62/728,857, filed
(Continued)

(51) Int. Cl.

| | |
|---|---|
| ***B65D 41/34*** | (2006.01) |
| ***B65D 41/32*** | (2006.01) |
| ***B65D 55/16*** | (2006.01) |

(52) U.S. Cl.
CPC ..... *B65D 41/34* (2013.01); *B65D 41/325* (2013.01); *B65D 55/16* (2013.01)

(58) Field of Classification Search
CPC ..... B65D 39/00; B65D 41/34; B65D 41/325; B65D 41/32; B65D 47/0838; B65D 47/36; B65D 55/16; B65D 55/024
USPC ..... 215/243, 237, 235, 296, 329, 316, 356, 215/355, 253, 252, 250, 306; 220/811, 220/810, 345.1, 266, 265, 375, 801, 802, 220/803
See application file for complete search history.

(56) References Cited

U.S. PATENT DOCUMENTS

| | | | |
|---|---|---|---|
| 2005/0173368 A1 | 8/2005 | Nusbaum et al. | |
| 2014/0001182 A1 | 1/2014 | Wood et al. | |

(Continued)

FOREIGN PATENT DOCUMENTS

| | | | |
|---|---|---|---|
| EP | 0844190 B1 | 1/2002 | |
| FR | 2657066 B1 | 5/1992 | |
| WO | WO-0249929 A1 * | 6/2002 | ..... B65D 41/325 |

OTHER PUBLICATIONS

International search report dated Oct. 15, 2019.

*Primary Examiner* — Robert J Hicks

(57) ABSTRACT

The present invention relates to a tethered screw plastic stopper, comprising a tamper shell positioned around the stopper. The tamper shell includes a retaining feature operable to cooperate with a top ring extending outwardly around a bottle neck. The stopper also includes a roof connected to the tamper shell through a hinge and separably connected to the tamper shell through a weakness line, wherein the tamper shell may be moved downwardly in rotation into an opened position.

14 Claims, 8 Drawing Sheets

Related U.S. Application Data on Sep. 9, 2018, provisional application No. 62/730, 211, filed on Sep. 12, 2018.

(56) References Cited

U.S. PATENT DOCUMENTS

| | | | |
|---|---|---|---|
| 2015/0298870 | A1 | 10/2015 | Graux et al. |
| 2018/0141727 | A1 | 5/2018 | Luzzato |

* cited by examiner

TETHERED PLASTIC STOPPER

TECHNICAL FIELD

This present disclosure relates generally to closures for containers. More specifically, the present disclosure relates to a tethered closure secured to a bottle neck.

BACKGROUND

In the field of liquid packaging, it is very common to seal the aperture of a container with a stopper, often made from a plastic material. Such a container is usually a plastic bottle, but other materials may be used as well.

The stopper typically has a tubular shape closed at its top edge by a top wall. The stopper comprises a closure shell attached to a tamper band through the implementation of bridges. Bridges are distributed around the circumference of the closure shell and the tamper band. Moreover, the bridges may be made when molding the stopper or after through undergoing a cutting step during the manufacturing process.

Usually the bottle neck finish comprises outer fixation features, such as threads to receive a screw-type stopper. For screw type stoppers, the closure shell typically comprises inner thread(s) arranged on an inner side wall that are intended to engage with outer thread(s) located on the bottle neck finish. Such combinations of outer and inner thread(s) allow the stopper to be screwed on a bottle neck finish to seal it and unscrewed for bottle entirely opening.

Alternatively, the bottle neck finish comprises outer fixation features, such as annular fixation rings to receive a snap-type stopper that secures the stopper onto the bottle neck finish. A snap-type stopper includes an inner annular area and the bottle neck finish fixation feature includes an outer fixation ring, in order secure (e.g., using a downward force) the stopper onto the bottle neck finish. A snap type stopper comprises a closure shell with a movable sealing roof from a closure position to a part opening, and reversely. The roof may be separating upon opening or may be connected with the closure shell.

In a sealing position of the stopper, the tamper band is secured around the bottle neck finish through inner tamper band retaining features or through the tamper band diameter being smaller than a diameter of a tamper evident ring of the bottle neck finish.

The closure shell is typically removable. During bottle opening, the bridges form a weakness line and are torn apart from the closure shell, so it can be separated from the bottle. The weakness line is torn when user unscrews the closure shell of the stopper or when user lifts the roof by tilting.

After opening, the closure shell can be completely removed and discarded (e.g., dropped), preventing subsequent closure of the bottle. Additionally, the removed closure can represent waste if not recycled.

Other known art prior art systems include a tethered stopper comprising a spiral strip. The spiral strip is made during the stopper molding so there is no cutting or slitting operations. Other known prior art systems includes tethered stoppers comprising two strips linking the closure shell to the tamper band secured on the bottle neck.

SUMMARY

This invention involves an improved tethered plastic stopper that includes a closure shell capable of remaining attached to its tamper band by a linking feature after the bottle is opened. The stopper includes a screwed tamper shell that is downwardly moved by rotationally screwing relative to the bottle neck, in order to open the closure shell. In an opened position, the screwed tamper shell remains attached the closure shell and the bottle neck, allowing the consumer to drink without bothering to first throw away the closure shell. This configuration permits a user to securely close the bottle neck to the closure shell by unscrewing the tamper shell, which is upwardly moved.

In some embodiments, the stopper may be configured to close a bottle by snapping the roof of the stopper so that the bottle can be opened without the entire stopper being removed from the bottle and without the roof being separated from the stopper. The tamper shell rests on the top of the transport ring so that when first sealing through insertion of the stopper on the bottle, the entire stopper weakness line connection remains unbroken.

In some embodiments, the roof remains attached to its tamper shell after bottle opening and may be linked to the tamper shell through a hinge. The stopper includes a screw tamper shell, which is upwardly unscrewed relative to the bottle neck, in order to open the roof.

In an opened position, the tamper shell may be screwed to lock the roof in an opened position, allowing the consumer to drink without being bothered by the roof. Also in the closed position, the tamper shell secures closing, and the roof cannot be opened without unscrewing the tamper shell, which secures closing. The roof may include a longer sealing feature inserted into the bottle neck; the inward length of the sealing feature may be designed to only move vertically relative to the bottle neck. When in the closed position, the tamper shell is in a low position. In other words, when the roof is inserted into the bottle neck, the sealing feature length prevents the roof from being moved in rotation around the hinge.

Other systems, methods, features, and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DESCRIPTION OF DRAWINGS

The figures are not necessarily to scale and some features may be exaggerated or minimized, such as to show details of particular components. Emphasis is placed on illustrating the principles of the invention. In the figures, like reference numerals designate corresponding parts throughout the different views.

DETAILED DESCRIPTION

As required, detailed embodiments of the present disclosure are disclosed herein. The disclosed embodiments are merely examples that may be embodied in various and alternative forms, and combinations thereof. As used herein, for example, exemplary, and similar terms, refer expansively to embodiments that serve as an illustration, specimen, model or pattern.

In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Phrasing such as 'configured to' perform a function, including in the claims, can include any or all of being sized, shaped, positioned in the arrangement, and comprising material to perform the function.

Terms indicating quantity, such as 'first' or 'second' are used for exemplary and explanation purposes and are not intended to dictate the specific ordering of a component with respect to other components. Terms indicating position such as 'upper' and 'lower' or 'front' and 'back' are used to indicate components relation to one another. One of skill in the art would recognize other configurations are possible.

Various embodiments of the present disclosure are disclosed herein. The described embodiments are merely exemplary illustrations of implementations set for a clear understanding of the principles of the disclosure. Variations, modifications, and combinations may be made to the described embodiments without departing from the scope of the claims. All such variations, modifications, and combinations are included herein by the scope of this disclosure and the claims.

Figure 1:
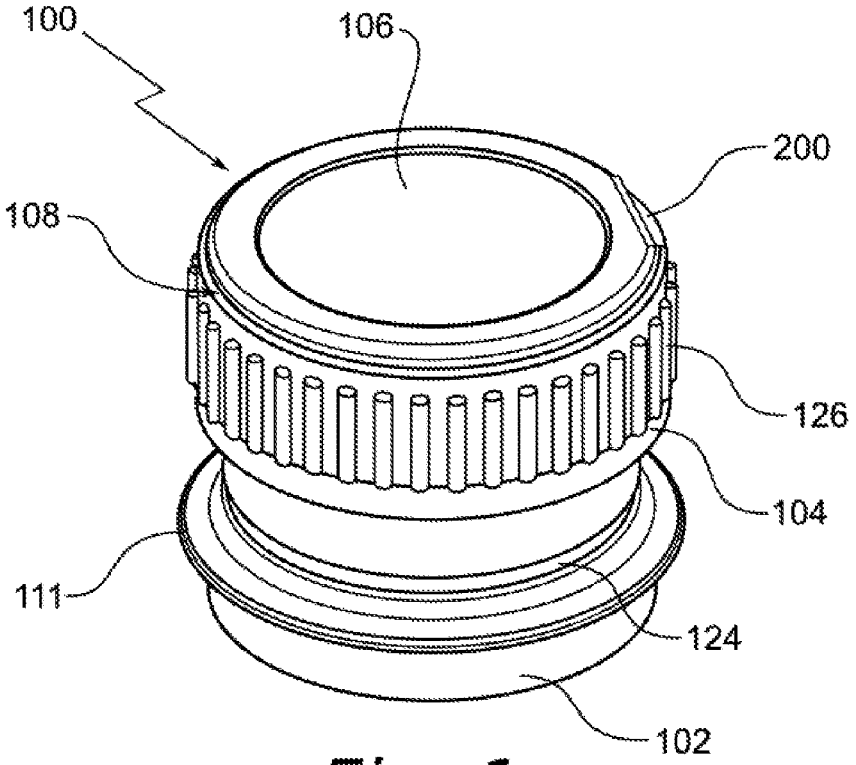
FIG. 1 is a diagrammatic perspective view of an embodiment of a tethered stopper secured on a bottle neck when the bottle is in a closed position.

FIG. 1 illustrates to a tethered plastic stopper 100, for closing a bottle neck 102. The stopper 100 is integrally made of a single plastic piece by a molding fabrication step and may be further developed by cutting and/or slitting operations. The stopper 100 includes a tamper shell 104 and a roof 106. The tamper shell 104 and the roof 106 are linked together around the roof 106. The roof 106 may be circular shaped and may be separably connected to the tamper shell 104 through a weakness line 108 located around the periphery of the tamper shell. In some embodiments, the tamper shell 104 includes outer knurls 126 to assist a user in gripping when screwing and unscrewing the shell 104.

According to one embodiment, the weakness line 108 may be made by bridges (not shown). The bridges are distributed almost all along the weakness line 108, separated regularly or not. Thus, when opening the roof 106, the bridges are torn apart from the roof 106 and from the tamper shell 104. According to the embodiment, the weakness line 108 may be made of a junction line (not shown), which has a thickness less than the thickness of the roof 106. Hence, when opening the roof 106, the junction line tears apart. The roof 106 remains attached to the tamper shell 104 through a hinge 200.

The hinge 200 may be connected to the bottom of the roof 106 and the top of the shell 104. In some embodiments, the roof 106 may be moved radially through perpendicular to the tamper shell 104 and reverses when closing. The hinge 200 may extend between about 5° and 150° relative to the periphery of the stopper 100. The hinge 200 angularly may be moved more than about 180° from its closed position to its opened position and closed.

In some embodiments, the roof 106 may pivot relative to the tamper shell 104 and reversely pivot when closing. The hinge 200 may extend angularly between 5° and 90°, especially between 5° and 25°, relative to the periphery of the stopper 100.

According to the embodiment, the roof 106 may include a sealing feature 202, which allows the roof 106 to be watertight on the bottle neck 102 in a closed position. The sealing feature 202 may further include an annular lip 314 extending downwardly from the bottom face the roof 106. The outer periphery of the annular lip 314 includes an embossment that, when in the closed position, is compressed against the inner wall of the bottle neck 102, allowing sealing.

In some embodiments, the annular lip 314 extends downwardly according to a length that allows for almost an entire vertical movement from the roof 106 relative to the bottle neck 102. For example, the complete pivoting movement of the roof 106 around the hinge 200 may not be possible in the bottom position of the tamper shell 104. The length of the lip 314 may be designed so that the pivoting movement of the roof 106 around the hinge 200 may be possible only when the lip 314 is high enough to be partially disengaged from the bottle neck 102 or only partially inserted therein. The length of the sealing feature 202 prevents the roof 106 from being opened or closed because the bottom edge of the lip 314, especially opposite the hinge 200, prevents rotation of the roof 106 around the hinge 200.

The length of the sealing feature 202 may depend on the dimensions and diameter of the stopper 100 and of the bottle neck 102, in particular the inner diameter of the bottle neck 102. The length of the sealing feature 202 may also depend on the plastic elasticity of the stopper 100. The length of the sealing feature 202 may also depend on the number of lips 204 and the shape of each lip 314. In the secured opened position, when the tamper shell 104 is moved to the low position, the top edge of the bottle neck 102 is free.

The tamper shell 104 includes retaining features 116 designed to engage the bottle neck 102 when closed and to assist in securing the stopper 100. The retaining features 116 extend from an inside face of the tamper shell 104. In some embodiments, the retaining feature 116 extends from an inner face of the tamper shell 104 and may form a collar around the periphery of the tamper shell 104. The retaining features 116 locks the tamper shell 104 and the entire stopper 100 against at least a top ring 118 positioned around the bottle neck 102.

According to an embodiment, the top ring 118 may be a tamper evident ring of the bottle neck 102. The top ring 118 may be recessed into an outer face of the bottle neck 102, so the retaining features 116 slide into the top ring 118 preventing further upward movement. Moreover, when first sealing the stopper 100 on the bottle neck 102, the top ring 118 may secure the retaining feature 116.

In some embodiments, the tamper shell 104 may have limited movement, from a high position (engaged position) to a low position (disengaged position), and reversely. For example, at the highest position (engaged position), retaining features 116 push against the bottom of the top ring 302, and at the lowest position (disengaged position) the retaining features 116 push against the top of the transport ring 111.

Figure 2:
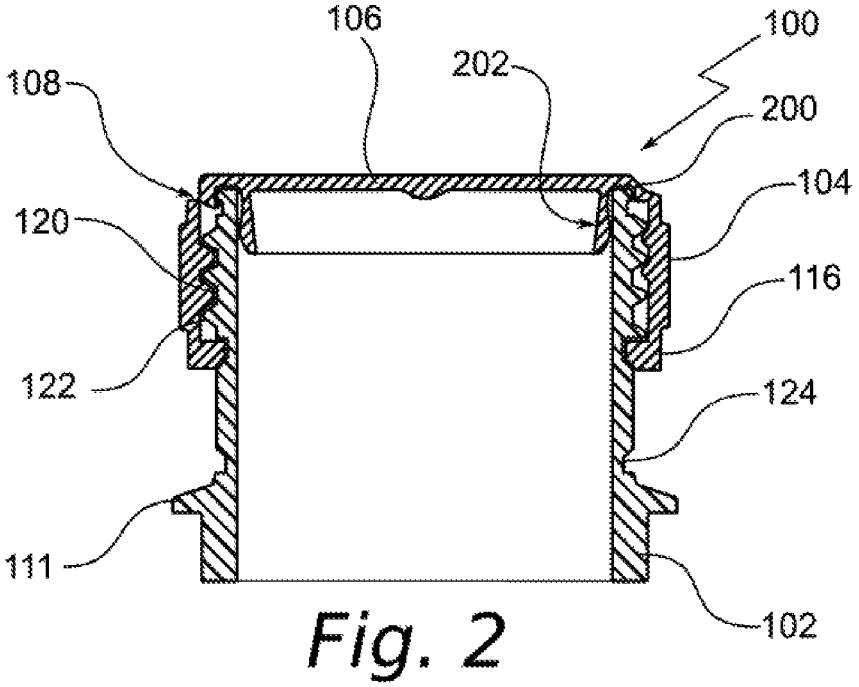
FIG. 2 is a cross-sectional view of an embodiment of the tethered stopper secured on the bottle neck when the bottle is in a closed position.
Figure 3:
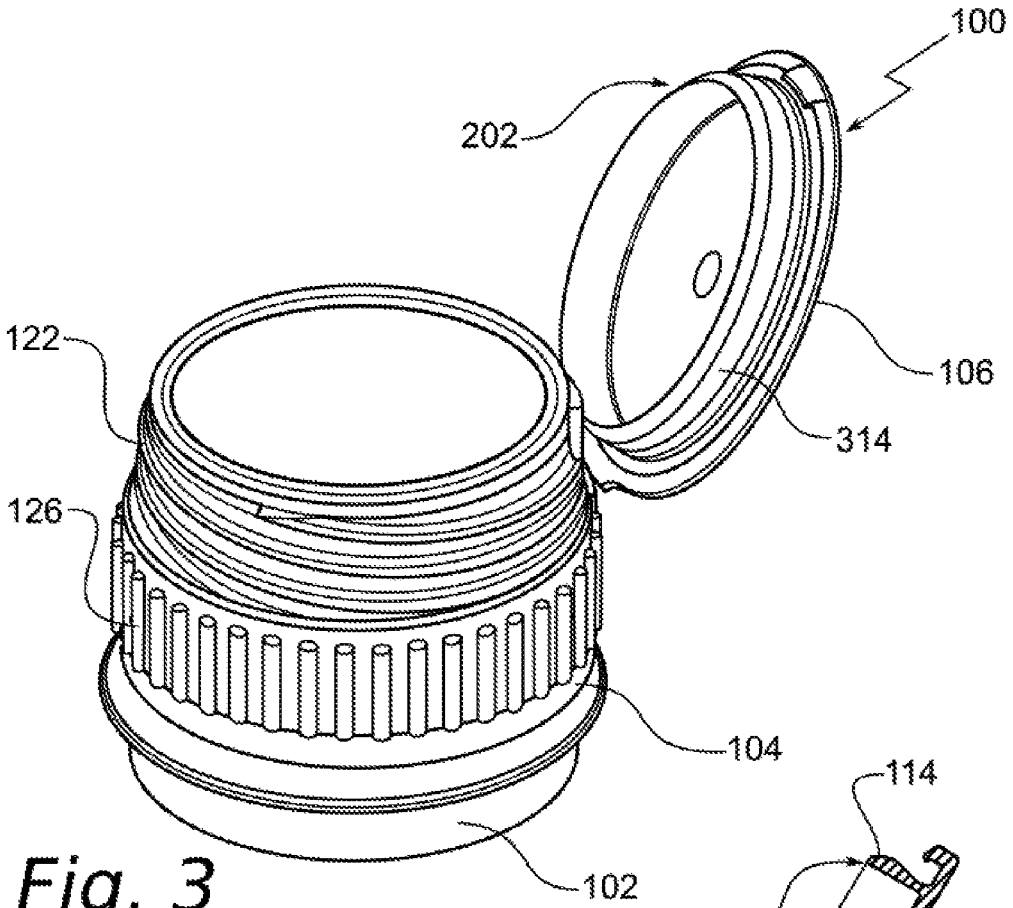
FIG. 3 is a diagrammatic perspective view of an embodiment of a tethered stopper secured on a bottle neck in the first step when the bottle is opened.
Figure 4:
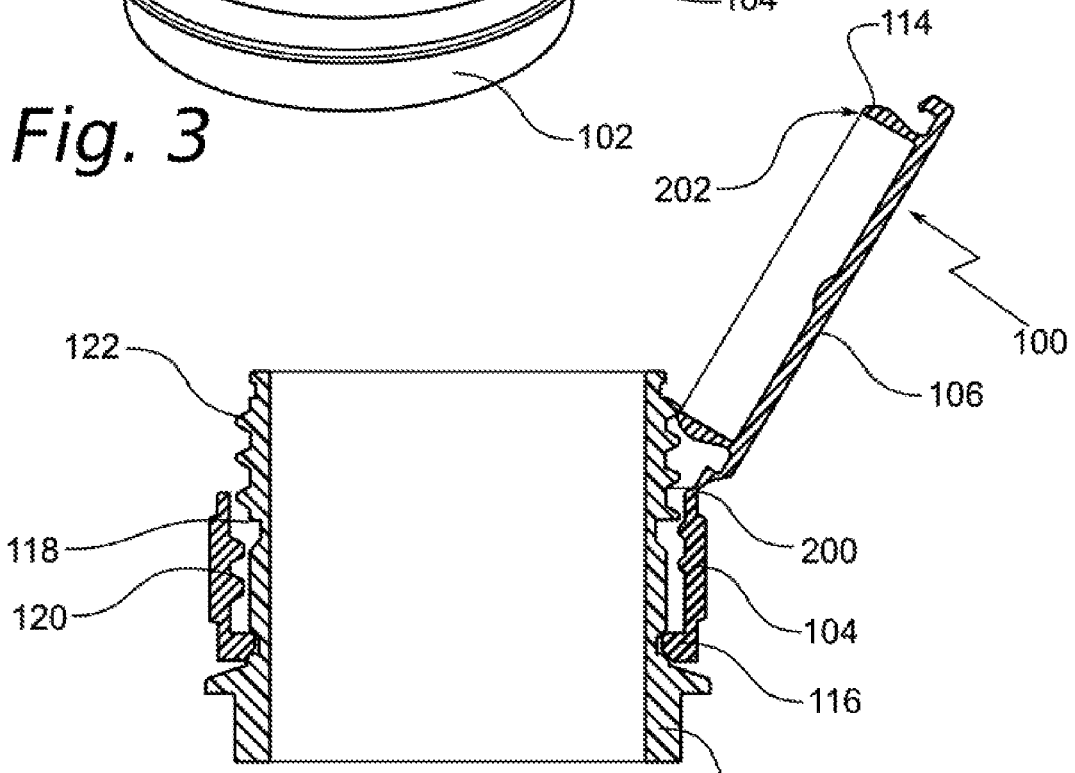
FIG. 4 is a cross-sectional view of an embodiment of the tethered stopper secured on a bottle neck in the second step when the bottle is opened.

When opening the stopper 100 from the bottle neck 102 the tamper shell 104 may be rotated downwardly on to the bottle neck 102. FIG. 2 illustrates the retaining features 116 positioned in the top ring 118 in the secured position, prior to opening. FIG. 4 illustrates the retaining features 116 positioned below the top ring 118, permitting the stopper 100 to be in the opened position.

The screwed tamper shell 104 may include an inner thread 120. The inner thread 120 cooperates with an outer thread 122 of the bottle neck 102. So when the screwed tamper shell 104 is moved in rotation, the inner thread 120 and the outer thread 122 permit the screwed tamper shell 104 to move upward or downward relative to the bottle neck 102. Upward or downward movement of the tamper shell 104 depends on the direction of the inner thread 120 and the outer thread 122. Hence, when downwardly moving, the roof 106 is pushed out of the bottle neck 102, where the sealing feature 202 is inserted, because of the linking to the tamper shell 104 through the hinge 200.

In an opened position, where the tamper shell 104 is downwardly positioned, the retaining feature 116 cooperates into a bottom ring 124 peripherally created into the outer face of the bottle neck 102. So the tamper shell 104 may be locked into this low position preventing upward moved without the hand action of the consumer. In the low position of the tamper shell 104, the roof 106 cannot be moved back into the closed position of the bottle neck 102.

According to an embodiment, the inner thread 120 and the outer thread 122 are left handed, which is inverted compared to the conventional rotating direction, the conventional rotating direction being clockwise to screw, and counter-clockwise to unscrew. Thus, when turning the tamper shell 104 counter-clockwise, instead of being moved upwardly outside the bottle neck 102, it is moved downwardly, and the stopper 100 is removed from the bottle neck 102. Conversely, when turning clockwise the tamper shell 104 is moved upwardly, and the stopper 100 is sealed to the bottle neck 102.

The inner thread 120 and the outer thread 122 are right handed so they extend in the conventional rotating direction. When opening the stopper 100 from the bottle neck 102, the consumer screws the shell 104 clockwise to downwardly force the roof 106 to open, and when closing the stopper 100 to the bottle neck, the consumer screws the shell 104 counter-clockwise to reseal the stopper 100 to the bottle neck 102.

According to an embodiment, the roof 106 may be fixedly attached to the stopper 100, which is secured on the bottle neck 102 through the tamper shell 104. Upon opening, the roof 106 may be automatically operated by the rotative movement of the tamper shell 104 relative to the bottle neck 102. Upon complete opening of the roof 106, the hinge 200 places the roof 106 far away from the top of the bottle neck 102, so as not to bother the consumer when drinking.

Figure 5:
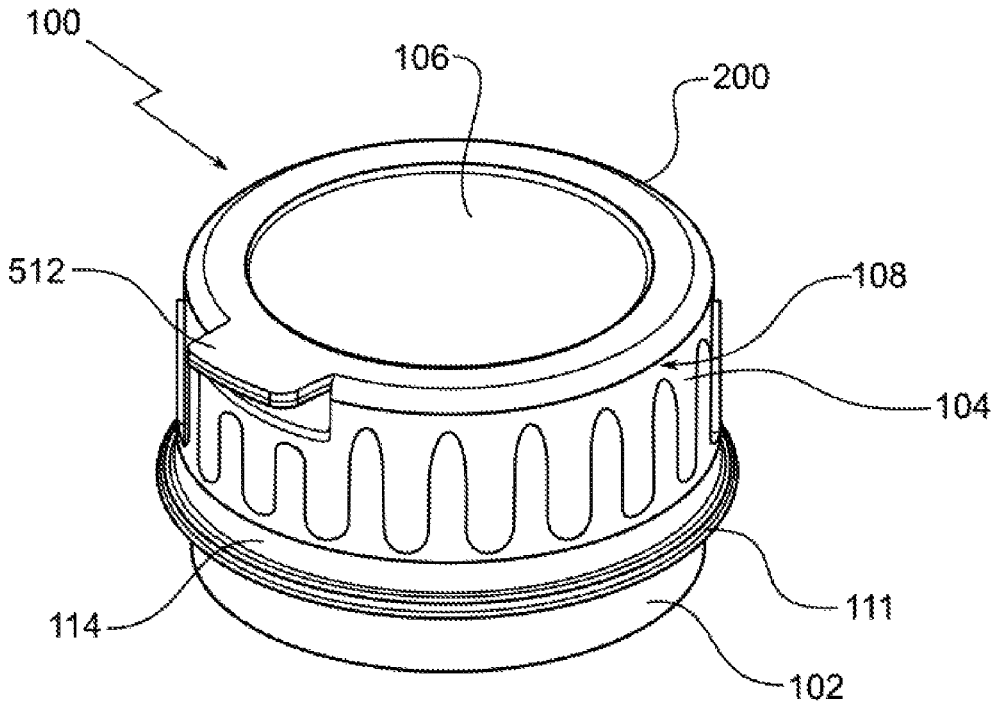
FIG. 5 is a diagrammatic perspective view of a second embodiment of the tethered stopper secured on the bottle while in the closed position.
Figure 6:
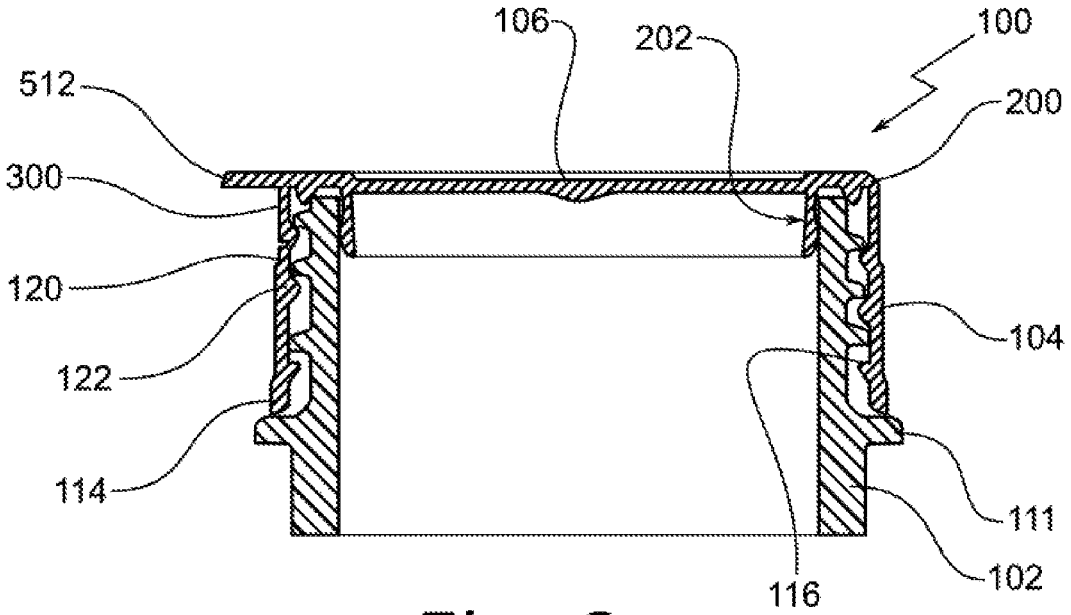
FIG. 6 is a cross-sectional view of the second embodiment of a tethered stopper secured on a bottle while in the closed position.
Figure 7:
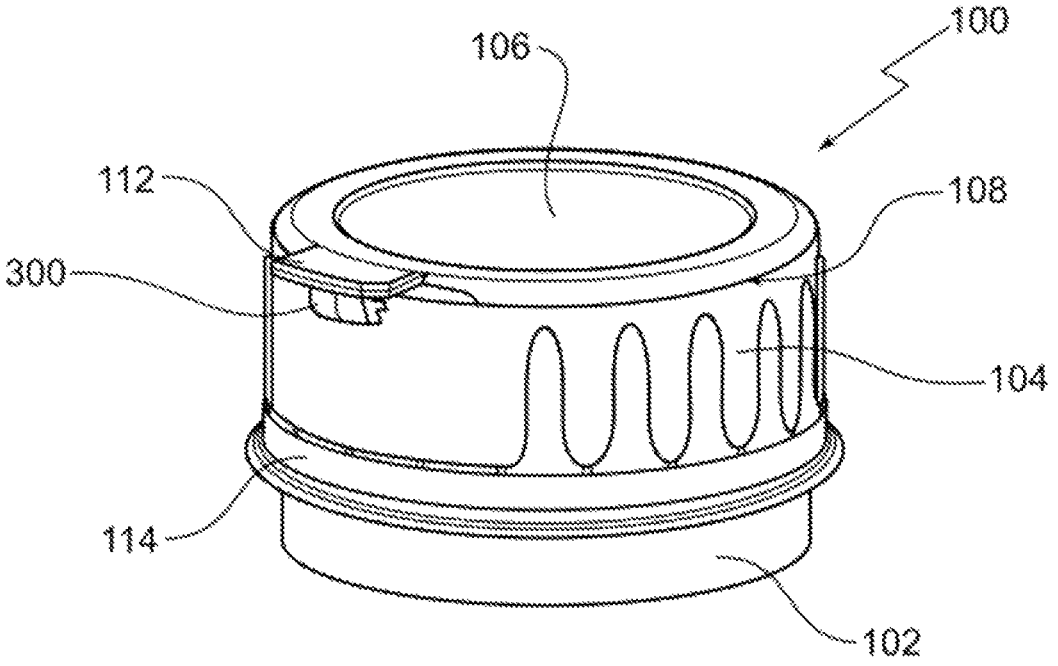
FIG. 7 is a diagrammatic perspective view of a third embodiment of the tethered stopper secured on a bottle while in a closed position.
Figure 8:
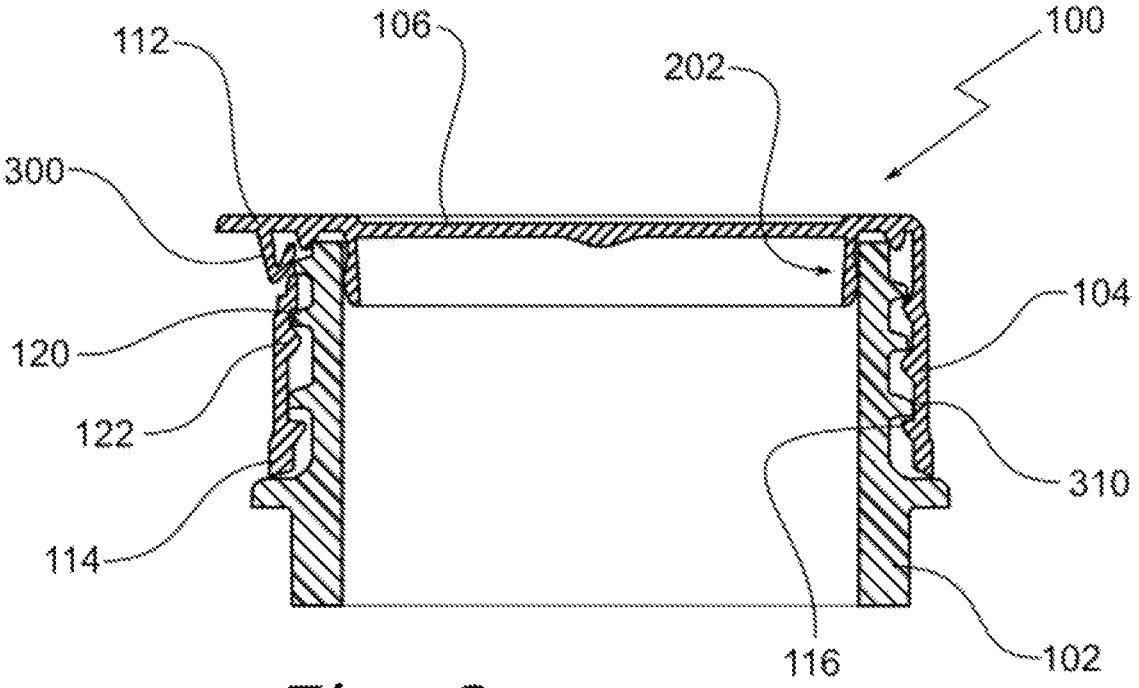
FIG. 8 is a cross-sectional view of the third embodiment of a tethered stopper secured on a bottle while in the closed position.

In some embodiments, opposite edge of the stopper 100 from the hinge 200, the tamper shell 104 comprises a tongue 512, illustrated for example in FIG. 5. The tongue 512 may outwardly extend relative to the periphery of the tamper shell 104, creating a handling feature to open the roof 106.

In some embodiments, the tongue 512 may include a hook 300 projecting downward from a bottom surface. The hook 300 may be inwardly oriented relative to the stopper 100, in order to grip the highest of an outer thread 122 of the bottle neck 102 or a special gap/opening/retaining feature inwardly created into an outer face of the tamper shell 104.

In some embodiments, the retaining feature 116 locks the tamper shell 104 and the entire stopper 100 against an outer ring 310 of the bottle neck 102. Under the outer ring 310 the bottle neck 102 may include an outer transport ring 111 extending peripherally. The bottle neck 102 may be a screw type including an outer thread 122. On the stopper 100, the tamper shell 104 includes an inner thread 120 designed to cooperate with the outer thread 122, in order to be screwed on the bottle neck 102 when sealing.

When sealing, the stopper 100 can remain intact. So when screwing the tamper shell 104 on the bottle neck 102, the inner thread 120 and the outer thread 122 cooperate such that the tamper shell 104 remains connected to the roof 106, and the weakness line 108 remains intact.

To assist in sealing, the tamper shell 104 may include a longer bottom portion in order provide contact with a top edge of the transport ring 111. In that way, when sealing by screwing the tamper shell 104 relative to the bottle neck 102, once fully sealed, the bottom of the tamper shell 104 engages the transport ring 111 and blocks movement, thereby allowing the weakness line 108 to remain intact. The tamper shell 104 may support the entire stopper 100 on the top of the transport ring 111.

The top ring 302 may include a tamper evident ring around the bottle neck 102. The bottle neck 102 may also comprise a transport ring 111 located beneath the top ring 118 and an outer thread 122, which is complementary designed with an inner thread 500 created into the tamper shell 104. When sealing, the stopper 100 may be screwed on the bottle neck 102. When opening, the outer thread 122 and the inner thread 500 cooperate by unscrewing.

The tamper shell 104 may include at least a skirt 114. The skirt 114 extends downwardly beneath the retaining features. The skirt 114 may have a vertical length almost the vertical distance between the top of the transport ring 111 and the bottom of the outer ring 310 of the bottle neck 102.

The skirt 114 may extend angularly from about 5° to 360° relative to the periphery of the stopper 100. When there are several skirts 114, they are peripherally distributed relative to the tamper shell 104, spaced regularly or not.

The weakness line 108 may also be created when molding the stopper 100. The mold may include one or more lateral mold shells, which are horizontally moved sideways of the stopper 100 to be molded. The mold sandwiches may also hook 300 on both of its sides, and when removed extracts the molded stopper 100 from the mold. The weakness line 108 may also be created when molding the stopper 100. If the mold does not comprise specific sandwiching lateral mold shells, after molding, the stopper 100 may be directly extracted from the mold by force due to of the elasticity of the plastic material.

Figure 9:
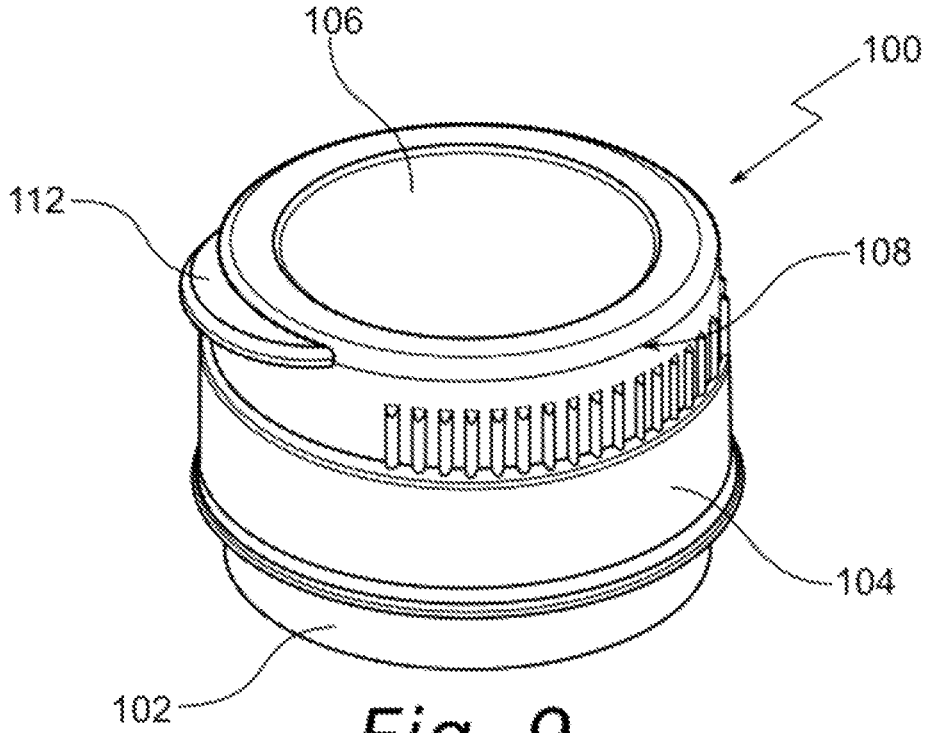
FIG. 9 is a diagrammatic perspective view of a fourth embodiment of a tethered stopper secured on a bottle neck, in a secured closed position.
Figure 10:
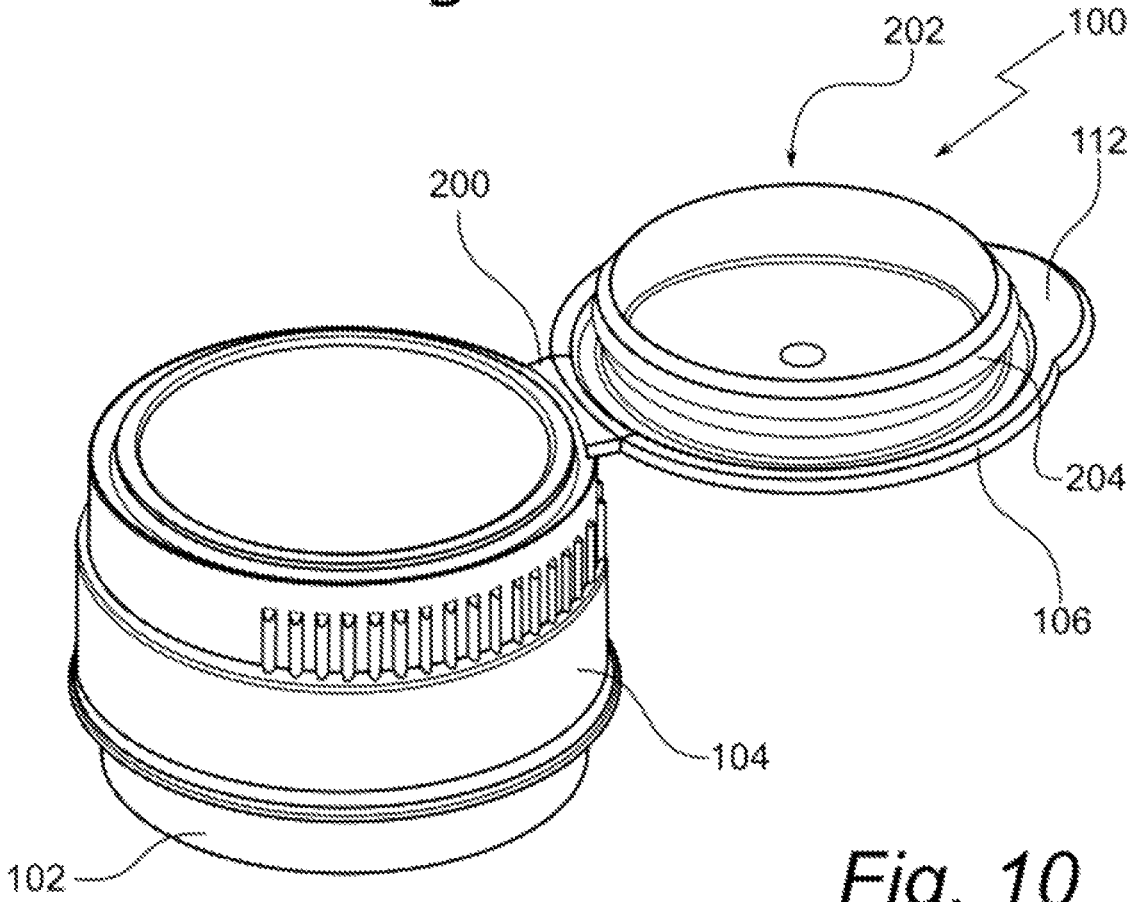
FIG. 10 is a diagrammatic perspective view of the fourth embodiment of the tethered stopper secured on the bottle neck, in a secured opened position.

In some embodiments, the roof 106 may be opened or closed by screwing or unscrewing of the tamper shell. For example, as illustrated in FIG. 9, when the tamper shell 104 is screwed in a low position, the roof 106 remains in a secured, either in an opened or closed position. Conversely, when the tamper shell 104 is unscrewed in a high position, the roof 106 may be opened, as illustrated in FIG. 10 relative to the bottle neck 102, and the roof 106 may be allowed to pivot for closing and opening.

Figure 11:
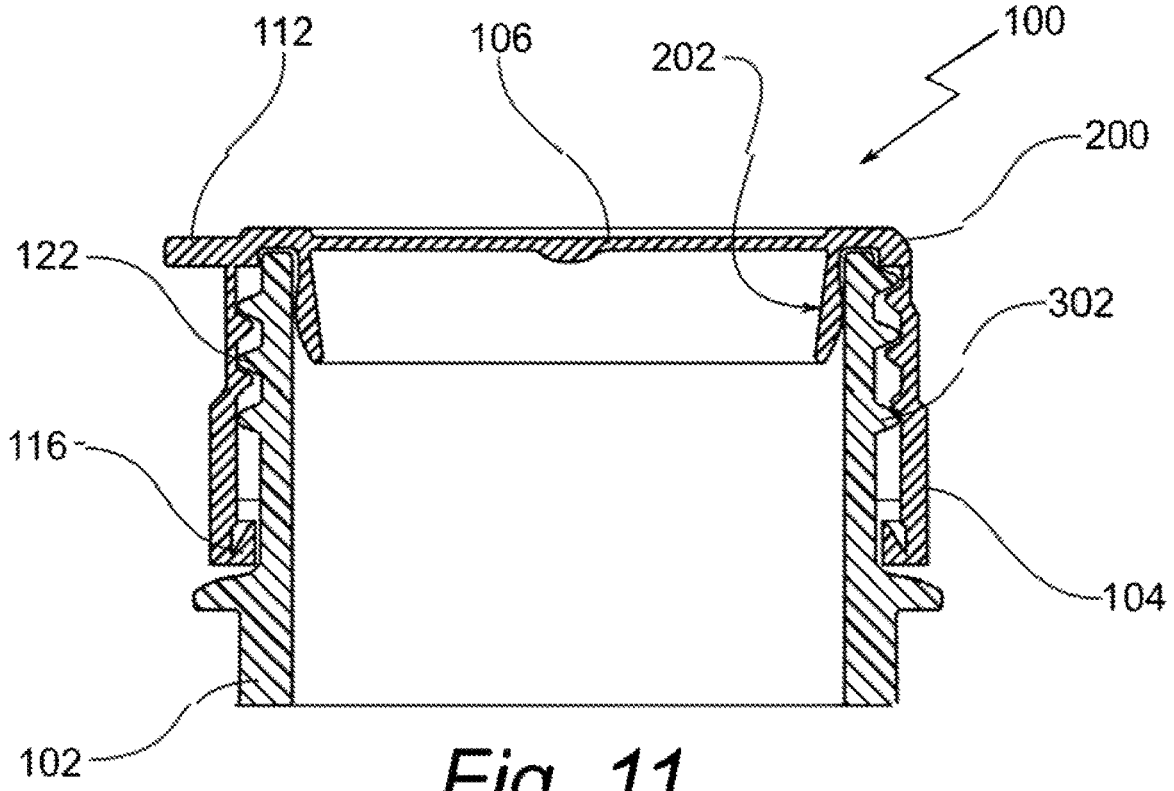
FIG. 11 is a cross-sectional view of the fourth embodiment of the tethered stopper secured on a bottle neck, in the secured closed position.
Figure 12:
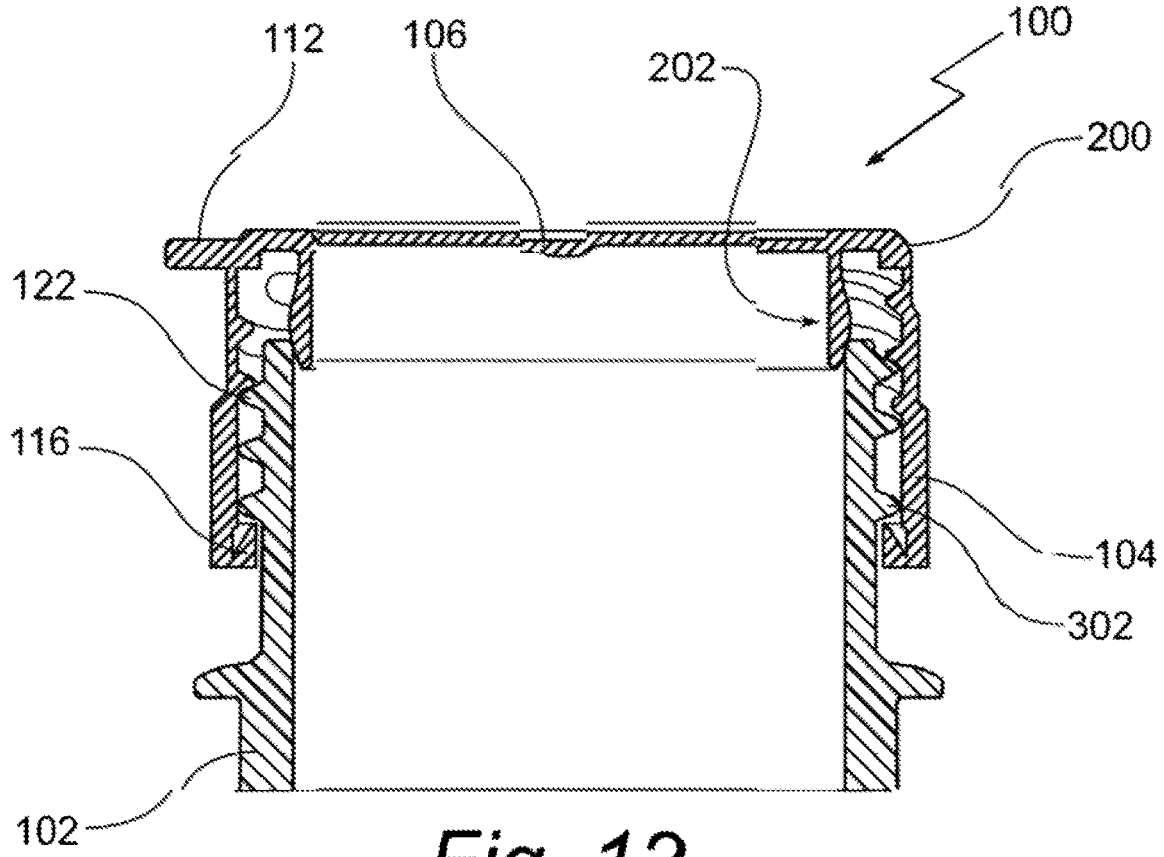
FIG. 12 is a cross-sectional view of the fourth embodiment of the tethered stopper secured on the bottle neck, in an unsecured closed position.
Figure 13:
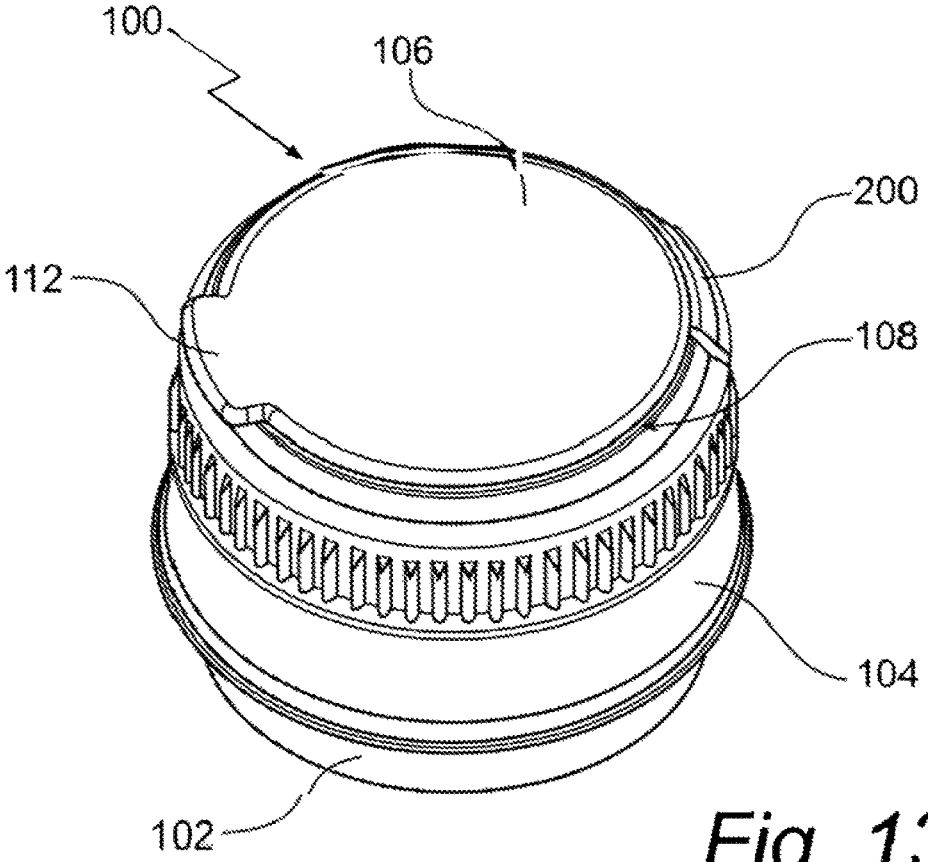
FIG. 13 is a diagrammatic perspective view of a fifth embodiment of a tethered stopper secured on a bottle neck, in the secured closed position.
Figure 14:
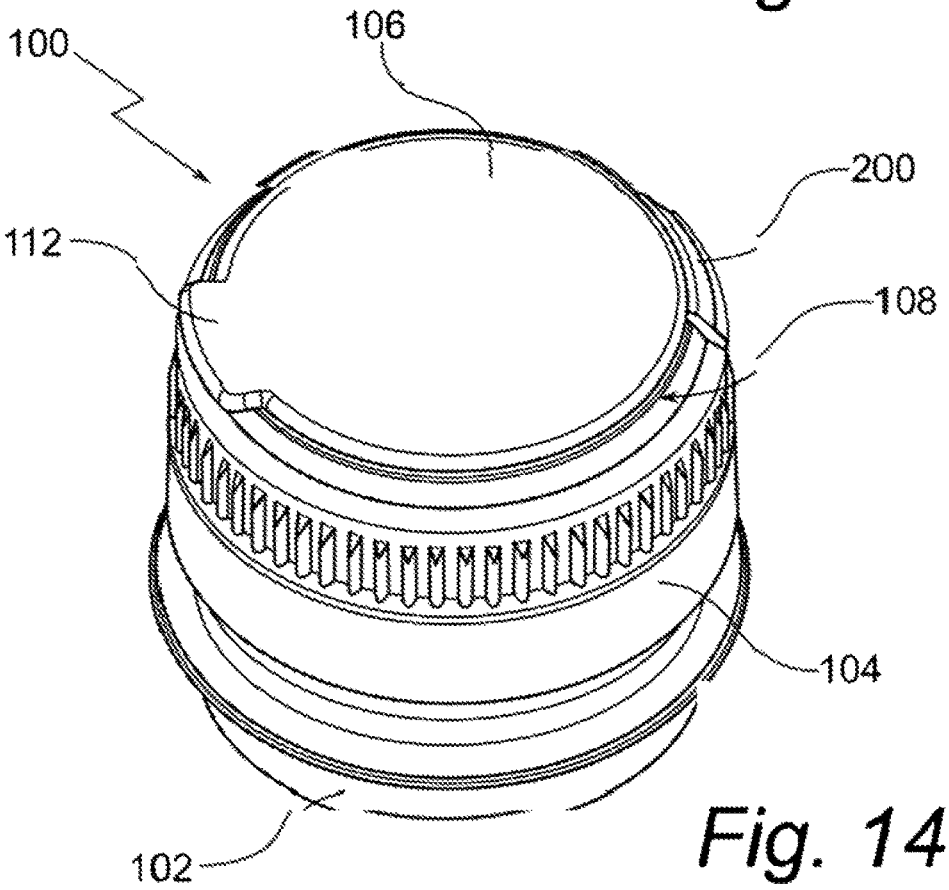
FIG. 14 is a diagrammatic perspective view of the fifth embodiment of the tethered stopper secured on a bottle neck, in the unsecured closed position.
Figure 15:
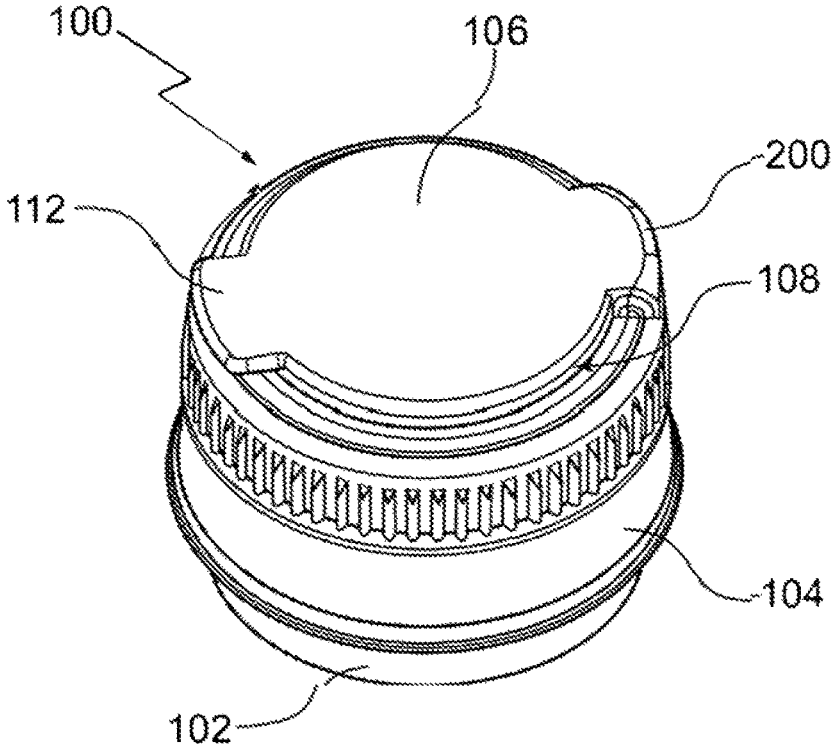
FIG. 15 is a diagrammatic perspective view of a sixth embodiment of a tethered stopper secured on a bottle neck, in the secured closed position.
Figure 16:
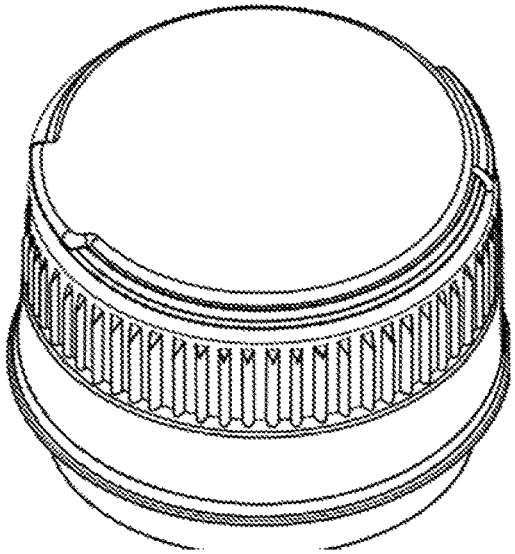
FIG. 16 is a diagrammatic perspective view of a seventh embodiment of the tethered stopper secured on a bottle neck, in the secured closed position.

In some embodiments as illustrated in FIGS. 11-12, the sealing feature 202 of the roof 106 extends further into the bottle neck 102. This longer sealing feature 202 is configured to prevent the roof 106 from being opened or closed if the tamper shell 104 is not unscrewed up to the highest position.

In some embodiments, the hinge 200 includes one pivot axis, which is configured laterally in V-shaped edges. When moving the roof 106 from unsecured closed position to the unsecured opened position, and reversely, the roof 106 turns around its pivot axis and the V-shaped edges invert. Such inversion of the V-shaped edges is designed to confer a tilting that maintains the roof 106 to the side of the unsecured opened position, and reversely.

In some embodiments, the hinge 200 may include one pivot axis, but it also may include an offset in order to further lower the roof 106 relative to the tamper shell 104 in the opened position, especially in the secured opened position. In the secured opened position, the roof 106 is configured to provide more clearance on the bottle neck 102 to avoid interference with the user.

Figure 17:
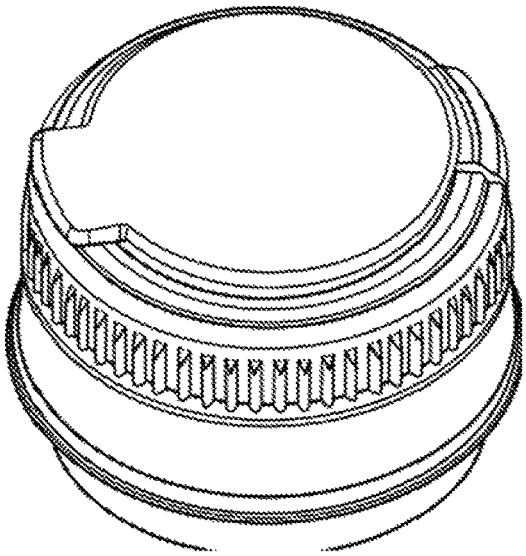
FIG. 17 is a diagrammatic perspective view of an eighth embodiment of a tethered stopper secured on a bottle neck, in the secured closed position.

In some embodiments, the hinge 200 may include a double pivot axis, which is designed to allow the roof 106 to be moved more than about 180° around the hinge 200. In some embodiments, as shown in FIG. 17, the tongue 512 may outwardly extend relative to the edge of the roof 106, but does not outwardly extends further than the periphery of the stopper 100.

The roof 106 is not removable from the stopper 100 secured on the bottle neck 102 through the tamper shell 104. The closing and opening of the roof 106 may be secured by screwing the tamper shell in the low position. In opening, the roof 106 may be pivotally moved away from the top of the bottle neck 102, so as not to bother the end user when drinking.

While various embodiments of the invention have been described, it will be apparent to those of ordinary skill in the art that many more embodiments and implementations are possible that are within the scope of this invention.

What is claimed is:

1. A tethered screw plastic stopper, comprising:

a tamper shell positioned around the stopper, the tamper shell including a retaining feature operable to cooperate with a top ring extending outwardly around a bottle neck;

a roof connected to the tamper shell through a hinge and separably connected to the tamper shell through a weakness line, wherein the tamper shell may be moved downwardly in rotation into an opened position.

2. The tethered plastic stopper according to claim 1, where in the opened position, the retaining feature cooperates with a bottom ring extending outwardly around the bottle neck.

3. The tethered plastic stopper according to claim 1, where an inner thread of the tamper shell and an outer thread of the bottle neck are inverted, so the tamper shell is downwardly moved to an opened position by rotating the tamper shell counterclockwise and the tamper shell is upwardly moved to a closed position by rotating the tamper shell clockwise.

4. A tethered plastic stopper, comprising:

a tamper shell having a wall designed to fit around a bottle where the tamper shell further comprises:

a roof having a periphery and positioned on top of the wall, where the wall surrounds the periphery of the roof;

a skirt forming the far end of the wall from the roof;

an inner thread on the inside of the wall between the roof and the skirt; and a retaining feature on the inside of the wall between the inner thread and the roof, and where the wall of the tamper shell is separably connected to the roof through a weakness line, and the roof is linked to the tamper shell through a hinge.

5. The tethered plastic stopper of claim 4, wherein the retaining feature is configured to cooperate with an outer ring positioned on a bottle and where the inner thread is configured to cooperate with an outer thread positioned on the bottle.

6. The tethered plastic stopper of claim 5, wherein the bottle further includes a transport ring below the outer ring configured to block the skirt of the stopper when securing the stopper to the bottle.

7. The tethered plastic stopper of claim 6, wherein the skirt angularly extends between about 5° and 360° relative to the wall of the stopper.

8. The tethered plastic stopper of claim 6, wherein the tamper shell further includes several skirts peripherally distributed.

9. A tethered plastic stopper, comprising:

a tamper shell positioned around the stopper and further including:

a retaining feature designed to cooperate with a top outward ring on a bottle neck;

an inner thread designed to cooperate with an outward thread on the bottle neck; and a roof positioned on top of the stopper above the tamper shell and connected to the tamper shell and through a weakness line, and the roof linked in pivotal rotation through a hinge, and further including:

a sealing feature that extends downwardly, the sealing feature including an annular lip with a length relative to a bottom face of the roof, and the lip designed for insertion into the bottle neck by pivotal rotation of the hinge when the tamper shell is disengaged.

10. The tethered plastic stopper according to claim 9, where when the tamper shell is engaged the retaining feature pushes against a transport ring on the bottle neck.

11. The tethered plastic stopper according to claim 9, where the hinge includes one pivot axis.

12. The tethered plastic stopper according to claim 9, where the hinge includes a double pivot axis.

13. The tethered plastic stopper according to claim 9, where the hinge comprises an offset.

14. The tethered screw plastic stopper according to claim 9, where the hinge includes V-shaped edges.

* * * * *